US007621217B2

(12) United States Patent
Atwater et al.

(10) Patent No.: US 7,621,217 B2
(45) Date of Patent: Nov. 24, 2009

(54) MODIFIED PRINTING PRESS

(75) Inventors: Richard G. Atwater, Rockford, IL (US); Clifford Eighmy, Lorna Linda, MO (US)

(73) Assignee: Controls Group Incorporated, Rockford, IL (US)

( * ) Notice: Subject to any disclaimer, the term of this patent is extended or adjusted under 35 U.S.C. 154(b) by 517 days.

(21) Appl. No.: 11/681,428

(22) Filed: Mar. 2, 2007

(65) Prior Publication Data

US 2008/0210113 A1 Sep. 4, 2008

(51) Int. Cl.
*B41F 31/00* (2006.01)

(52) U.S. Cl. ..... 101/366; 101/365

(58) Field of Classification Search ..... 101/366
See application file for complete search history.

(56) References Cited

U.S. PATENT DOCUMENTS 2,014,303 A * 9/1935 Weiss ..... 101/366
2,255,276 A * 9/1941 Breese ..... 431/336
3,722,778 A * 3/1973 Rohrberg et al. ..... 228/13
2003/0230207 A1* 12/2003 Momot ..... 101/366
2005/0268639 A1* 12/2005 Hortin et al. ..... 62/389

* cited by examiner

*Primary Examiner*—Jill E Culler
(74) *Attorney, Agent, or Firm*—Vedder Price P.C.

(57) ABSTRACT

An inking system for an offset printing press having a stationary portion and a movable portion that is movable toward and away from a roller. A plurality of hinge pins form a pivot axis between the stationary and movable portions. Each of the hinge pins having at least one hollow end portion communicating axially with one of the stationary and movable portions permitting ink flow. Each of the hinge pins also having a radial passage for ink, whereby the ink may pass from the stationary portion to the movable portion, and whereby the ink may be supplied to the movable portion during change of the relative positions of the stationary and movable portions.

14 Claims, 3 Drawing Sheets

MODIFIED PRINTING PRESS

BACKGROUND OF THE INVENTION

The present invention relates to a method and apparatus for delivering ink in a large offset printing press from the so-called page pack to the distribution head assembly. From the distribution head, the ink is transferred to a fountain roller, and from there to a series of conventional rollers in a newspaper printing application or other offset printing application.

According to the invention, there is a positive one-dimensional hinged connection between the page pack and other parts including the pivot block support base and the pivotable swing frame and related parts. In addition, the page pack preferably includes a manifold assembly which is readily detachable from its mating part, the stem assembly. The ink then preferably passes from page packs to the stem assembly, and then through various passages in the feed plate, the transfer plate and the pivot block support plates, then passes through a series of hollow hinge pins located by bearings and seals, and then finally to a series of interconnect hoses leading to the distribution head.

Because the swing frame mounting blocks pivot with respect to the pivot block support base, the ink passes through what is essentially a large multi-part hinge, allowing the distribution head and related parts to be swung toward and away from the fountain roller. Among the novel features are the structure of the parts and the manner in which the hinge and its associated parts function.

Prior art ink feed arrangement were quite different, with a plurality of hoses connecting the page pack(s) to the distribution head. Accordingly, this left a large array of free hoses, which were required to have a certain amount of flexibility because of their great length. Such hoses commonly began and continued to gather ink dust or other dust and impeded the ability to operate the swing frame in a clean manner. The hoses accordingly led directly from the page packs to the distribution head with a major part of the mechanism being not only subject to accumulation of dust and dirt, but this also kept the page packs surrounded by hoses and unable to be easily removed for maintenance.

Usually, there were 32 hoses in a four-page array, and these in turn were fed from a large manifold containing the printing ink. Accordingly, the ink was first passed into a plurality of page packs and then, from there, over the entire array and directly into the distribution head.

It would be desirable if a better arrangement of hoses and page packs or the like could be incorporated into a printing press.

Therefore, an object of the present invention is to provide an improved system for delivering ink in a large offset printing press.

Another object is to insure that, with the swing frame mounting blocks pivoting with respect to the pivot block support base, the ink could be routed along what is essentially a multi-part hinge from the page pack to the distribution head.

A still further object of the invention is to provide an apparatus in which the hinge was, in effect, pivotable about the pivot block support base, and the ink would travel axially along a hinge pin and then at right angles to the hinge pin in the swing frame mounting block and ultimately toward the interconnect hose.

A still further object of the invention is to provide a hinge system with a plurality of hinge pins, each pin having its end in an ink filled pocket, and in which the pivot block support bases would incorporate vertical ink passages and the swing frame mounting blocks would allow radial ink flow to the interconnect hoses.

Another object is to incorporate an axial hinge pin into the two ends of the swing frame mounting block for movement allowed by a series of bearings incorporated into the pivot block support base.

A further object is to incorporate ink seals which would ride on the hinge pins on their inside diameter and on the swing frame mounting block on their outside diameter.

Another object of the invention is to incorporate short interconnect hoses for ink between the swing frame mounting block and the distribution head assembly.

Another object of the invention is to provide a readily removable series of page packs, whereby the page packs could be removed and cleaned without tools and without difficulty.

A still further object of the invention is to provide a page pack with a series of ink passages terminating in stem receiving structures which register with but are removable from stem assemblies.

Another object of the invention is to provide a stem assembly which can accommodate a stem receiving structure in the page pack, and in which the stem receiving structures drops freely over the stem assembly.

A still further object of the invention is to provide a stem assembly which registers with the stem receiving structure in the page pack and allows the stem receiver and the stem to be treated as a unit in use.

SUMMARY OF THE INVENTION

Accordingly, there is typically a long, multi-part hinge, substantially the same width as the length of the distribution head, with the hinges serving as a conduit for the ink, which is fed from the page pack(s), preferably separable from the stems, through the fixed parts of the hinge, to the movable parts thereof and finally to the interconnect hoses and to the distribution head.

These and other objects in the manner of their attainment will become more clear when considered in connection with the following detailed description of the invention and shown in the accompanying drawings in which like reference numerals indicate corresponding parts throughout.

BRIEF DESCRIPTION OF THE DRAWINGS

FIG. 1 also shows a cut-away view of the page pack and the direction of the ink flow as it goes through various passages from the page pack to the stem assembly and beyond.

DESCRIPTION OF THE PREFERRED EMBODIMENTS

The invention is typically embodied in a large offset press, which normally would have two to six page packs and a continuous series of rollers extending the width of the press. In such presses, it is always necessary to have a movable distribution head swing through an arc to go from an operating position, wherein it is adjacent to the fountain roller, and in another position, wherein the distribution head assembly and related parts are spaced apart from the fountain roller. A description will now be made of a typical offset press, and the portions thereof with which the invention is concerned.

Figure 1:
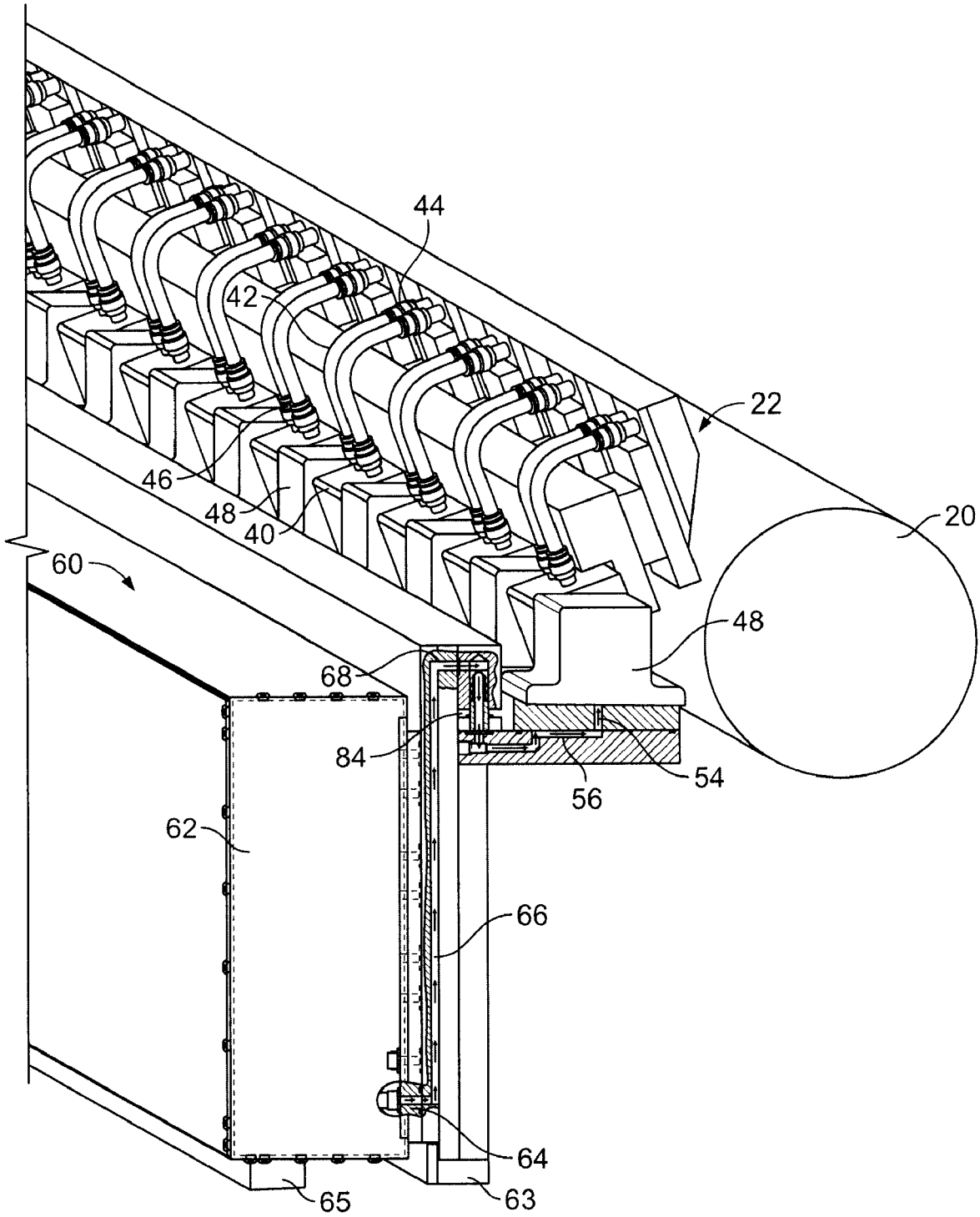
FIG. 1 is a perspective view showing the interconnect hoses that extend between fixed parts of the distribution head and the swing frame, and the pivoting action which enables the swing frame to move toward and away from the fountain roller.
Figure 2:
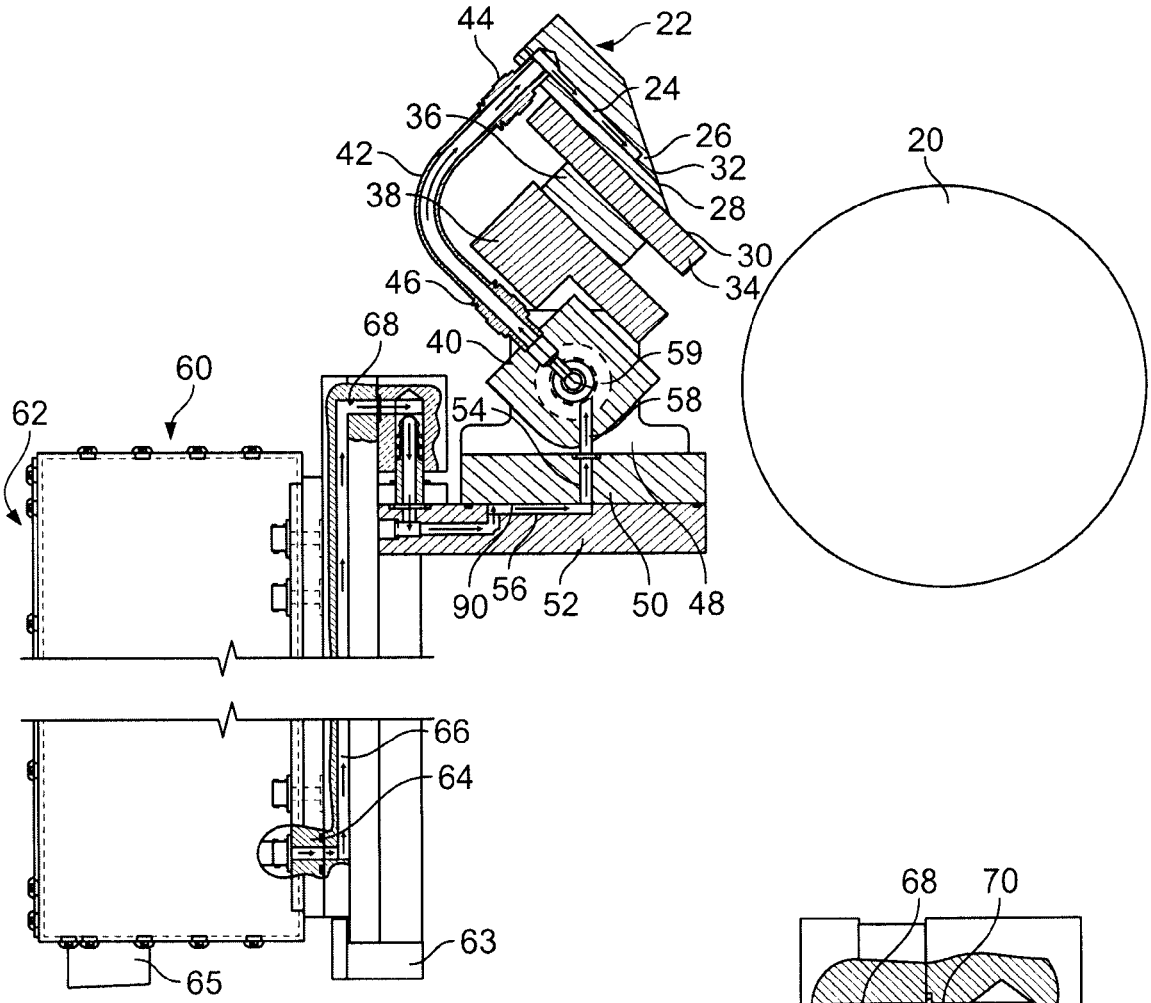
FIG. 2 is a vertical sectional view showing the assembled page pack, the stem assembly, and shows the pivoting action of the swing frame, and shows related parts moved away from the fountain roller.

Accordingly, and referring now to FIGS. 1 and 2, there is shown a fountain roller 20 with the distribution head assembly generally designated 22 including an ink passage 24, and the reduced thickness passage 26, and this passage may narrow further toward the end of the tapered face 28 on the lower margin of the distribution head assembly.

The transfer blade 30 lies just below the narrow end of the ink passage 32. An adapter plate 34 comes next, and this is secured to a spacer block 36, which in turn is attached to the swing frame 38. The swing frame in turn is attached to the swing frame mounting block 40. These parts, together with the interconnect hose 42 and its individual fittings 44, 46 constitute the moveable parts of the distribution head assembly. These portions are adapted to swing counterclockwise as shown in the drawings, to leave a substantial space between the distribution head assembly and the fountain roller.

Portions of the press unit which are fixed include a pivot block support base 48, a transfer plate 50, and a feed plate 52. Each of the feed plate and the transfer plate are drilled, milled, or otherwise machined to provide passages 54, 56, for ink to flow therethrough. Accordingly, the ink flows through the vertical passage 58 into a stationary pocket 59 in the pivot block support base 48. The remainder of these components and their functions will be described presently.

Figure 3:
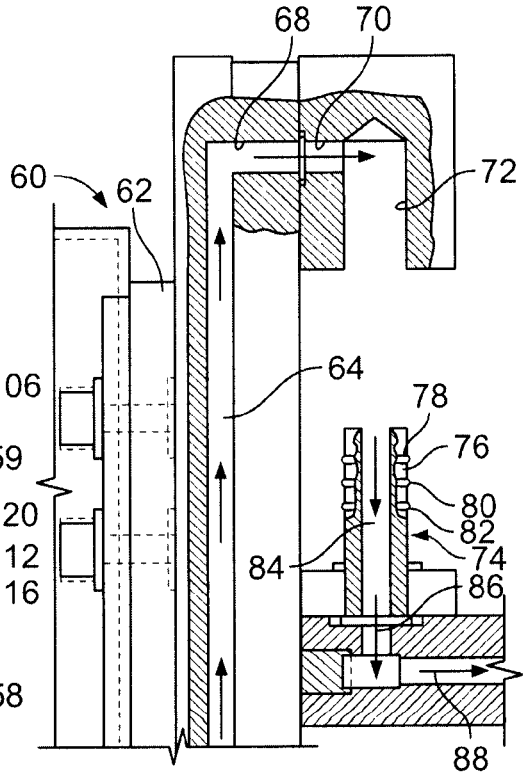
FIG. 3 is an exploded vertical sectional view, on a greatly an enlarged scale, showing a portion of the page pack including the receiver, and the manner of its removable attachment to the stem assembly.

Referring now in particular to FIGS. 2 and 3, there is shown a page pack generally designated 60, and shown to include an ink reservoir generally designated 62, and an L-shaped and rectangular support structure 63, 65. The page pack has a plurality, usually 8, of individual passages, one of which will now be described. Each one of these passages includes a horizontal passage 64, a vertical passage 66, and a topmost horizontal passage 68 in this embodiment of the invention.

The ink from here flows down through another horizontal passage 70 in the stem receiver, and into the stem housing 72 which connects removably with a stem generally designated 74. The stem 74 is shown to include a circular sidewall portion 76, plural O rings 78, 80, 82, and a center passage 84. The ink then passes from the center passage 84 through the short vertical passage 86 and then horizontally through the passage 88, where it meets with the passage 90 (FIG. 2) in the feed plate 52. From here, the ink passes through the ink passages 56, 54 and 58, and ends up in a pocket designated 59.

The function of the page pack is to feed separate streams of ink as desired by the layout of the paper and yet to be readily removable from the press for purposes of maintenance, changing the type or color of ink, etc. This can be done readily as the assembly 62, including all of the various passages is removable as a unit.

Figure 4:
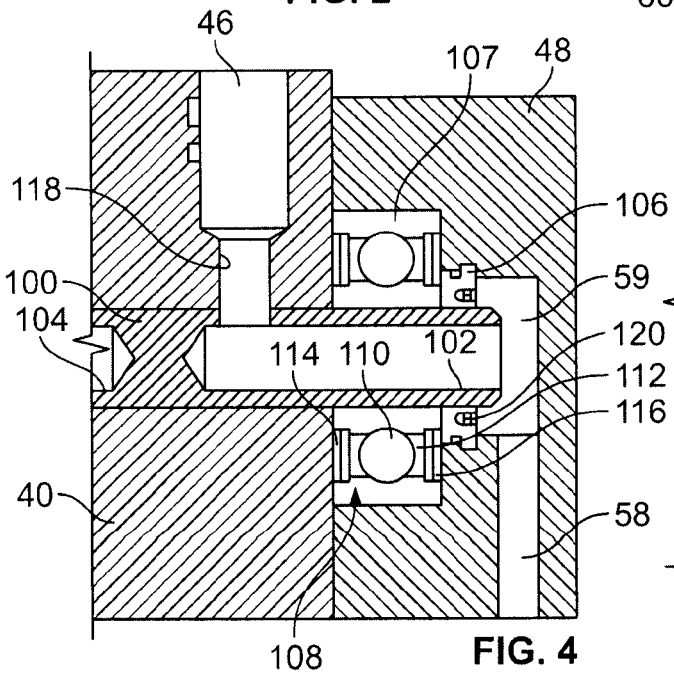
FIG. 4 is a vertical sectional view showing details of one hollow hinge pin through which the ink is fed, and showing the relative movement of the swing frame mounting block supported by bearings and a seal relative to the pivot block support base, and related parts.
Figure 5:
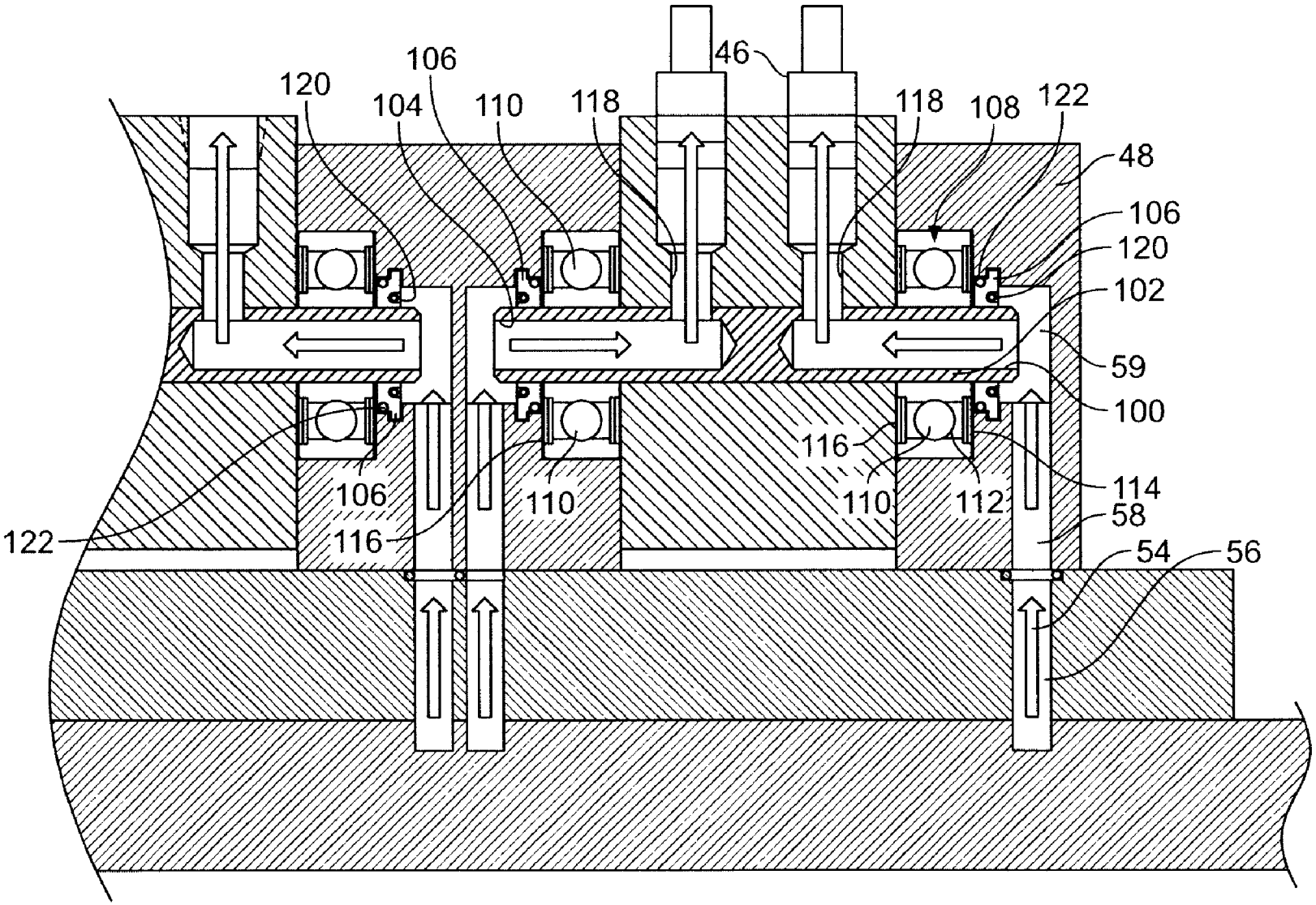
FIG. 5 is a vertical sectional view showing two end parts of one hinge pin and a part of another hinge pin and all their associated parts, and schematically showing the path of the ink as it flows through the various passages, including the feed plate, the transfer plate and the pivot block, and ultimately, through the passages and toward the interconnect hoses.

At this point, assuming that the ink has flowed through the various passages from the reservoir of the page pack 62, it will flow as shown in FIGS. 4 and 5. The pocket area 59 in the pivot block support base is served by the passage 58, which brings the ink into an area concentric with the hinge pin 100 having two cavities 102, 104. This hinge pin 100 is double-ended (FIG. 5) so as to have a passage 102 that preferably has a depth of just less than half of the extent of the hinge pin 100. The other end 104 has a similar depth.

The hollow hinge pin 100 is centered in the swing frame mounting block 40, and the pivot block support base 48 remains immobile at all times. The swing frame mounting block 40 pivots through an arc of perhaps 45 degrees. The small chamber or pocket 59 is filled with ink at up to 100 p.r.i. The seal 106 keeps the ink from leaking into the bearing assembly. The radial load is taken by a bearing assembly generally designated 108. This assembly 108 includes a center series of balls 110, a cage 112 and pair of shims on either of its sides 114, 116. The passage 102 in the hollow hinge pin 100 communicates with a radial passage 118 which in turn communicates with the fitting 46 at one end of interconnect hose 42.

From the foregoing example, one may appreciate that there will be a number of different manners in which the fountain roller and the distribution head may be separated from each other and return to their initial position from time to time. Accordingly, while the preferred apparatus for performing this function includes a distribution head and spacers, adapters, and swing frames, etc. as well as interconnect hoses for each column to be printed, this construction is only exemplary. The main concept is that a plurality of hinged pieces are located by hinge pins which have a hollow bore in their middle, and each of which serves to transfer the direction of the ink flowing therein from radial to axial to radial again, and then to the printing apparatus.

Likewise, the construction of the hinge mechanism is only exemplary. The preferred method includes a seal 106 closely surrounding the diameter of the hinge pin, and this seal includes a garter spring 120 for creating a radial load on the hinge pin 100, a radially outwardly acting spring 122 for maintaining a radial load on the housing 48 in which the seal 106 is located. In this way, the seal 120 is secure and it keeps the ink in the pocket, and also keeps the grease out of the pocket and in the bearing area where it is desired to be kept.

The construction has been shown using ball bearings, however, other methods might be used including roller or tapered roller bearings, or merely bushings, which would allow the bearings to be eliminated. The object here is to allow the hinge pins to be positively located with respect to the movable parts of the structure.

An example has been shown wherein the pivot frame mounting block uses a couple of fittings for the interconnect hoses. This is the best use of the application; however, it is not necessary that these flexible hoses be used, or the fittings be used with them, since another method of making this connection will occur to those skilled in the art. Likewise, the hoses have been shown to exit the fitting in pairs, but it is not strictly necessary that this be done. The most effective presently preferred way has been that which is described.

Regarding the page pack, the preferred method of providing the page pack so as to make it readily removable is the present concept. For example, the O-rings make an easily manufactured seal allowing the stem and the receiver to interfit is the preferred method, but another form of seal could be used, or the seal could be located elsewhere in the system. Likewise, the provision of the various holes or passages through the feed plate and the transfer plate is made so as to be most convenient and effective in the present application. However, every angle and turn is not necessary.

The page pack support is provided to limit the downward travel of the page pack, but other constructions could be used.

It will thus be seen that the present invention provides a construction having a number of advantages and characteristics including those pointed out and others which are inherent in the invention. Variations and changes to the described structure will occur to those skilled in the art, and such variations and changes may be made without departing from the invention or from the scope of the appended claims.

What is claimed is:

1. An inking system for an offset printing press, said press having a frame with a stationary portion, with said stationary portion having plural individual components each being spaced apart, and a movable portion of said press frame having plural individual components spaced apart and interleaved with said components of said fixed portion, said movable portion of said press frame including a portion which is movable toward and away from a roller used in said printing press, a plurality of hinge pins forming a pivot axis of said components movable relative to each other, each of said stationary components having at least one portion permitting ink flow from an ink supply, each of said hinge pins having at least one hollow end portion communicating axially with one of said portions permitting ink flow, each of said hinge pins also having a radial passage for ink, whereby said ink may pass from said stationary portion of said press to said movable portion of said press, and whereby said ink may be supplied to said portion which is movable toward and away from said roller during change of the relative positions of said stationary and movable parts of said inking system.

2. An inking system as defined in claim 1, wherein said stationary portion includes a pivot block support base.

3. An inking system as defined in claim 1, wherein said stationary portion includes a transfer plate.

4. An inking system as defined in claim 1, wherein said stationary portion includes a feed plate.

5. An inking system as defined in claim 1, wherein said stationary portion includes a pivot block support base, a transfer plate and a feed plate.

6. An inking system as defined in claim 1, wherein said movable portion of said press frame includes a distribution head assembly.

7. An inking system as defined in claim 1, wherein said movable portion of said press frame includes a swing frame mounting block.

8. An inking system as defined in claim 1, wherein said movable portion includes an interconnect hose extending from said swing frame mounting block to said distribution head assembly.

9. An inking systems as defined in claim 1, which further includes a page pack manifold assembly including a readily removable page pack and said stationary portion of said press includes a stem assembly and passages leading from said stem assembly to an ink receiver in said swing frame mounting block.

10. An inking system for an offset printing press, said press having a frame with a stationary portion, with said stationary portion having plural individual components each being spaced apart, and a movable portion of said press frame having plural individual components spaced apart and interleaved with said components of said fixed portion, said movable portion of said press frame including a distribution head which is movable toward and away from a roller used in said printing press, a plurality of hinge pins forming the pivot axis of said components movable relative to each other, each of said stationary components having at least one portion permitting ink flow from an ink supply, each of said hinge pins having at least one hollow end portion communicating axially with one of said portions permitting ink flow, each of said hinge pins also having a radial passage for ink, communicating with a radial passage in said movable component of said press frame, whereby said ink may pass from said stationary portion of said press to said movable portion of said press, and whereby said ink may be supplied to said distribution head during change of the relative positions of said stationary and movable parts of said inking system; and an ink reservoir, plural ink outlets, one outlet for each column of print to be inked, said system including plural separate individual passages, each of said passages including a vertically extending portion communicating at one end with said reservoir, a horizontally extending portion forming the uppermost extent of the passage, and a portion extending downwardly from said horizontally extending portion, and a freely removable connection of said downwardly extending portion to plural tubes on the body of said press, said tubes extending downwardly and communicating with at least one ink passage leading to said column, said freely removable connection being constructed and arranged so as to permit ready vertical removal of said reservoir.

11. An inking system for an offset printing press as defined in claim 1, wherein said movable plural individual components each include a double-ended hinge pin having a separate passage therein on each end for ink.

12. An inking system for an offset printing press as defined in claim 1, wherein said movable plural individual components each include a double-ended hinge pin communicating with an ink-receiving pocket in said stationary portion of said press.

13. An inking system for an offset printing press as defined in claim 1, wherein said movable plural individual components each include a double-ended hinge pin, said pin being supported on each of its ends by a roller bearing assembly.

14. An inking system for an offset printing press as defined in claim 13, wherein said movable plural individual components each include a double-ended hinge pin, and said stationary portion includes a pocket being isolated from said bearing assembly by a seal riding on said hinge pin.

* * * * *